US009020172B2

(12) United States Patent
Hillbratt et al.

(10) Patent No.: US 9,020,172 B2
(45) Date of Patent: Apr. 28, 2015

(54) METHODS, SYSTEMS, AND DEVICES FOR DETECTING FEEDBACK

(71) Applicant: Cochlear Limited, Macquarie University (AU)

(72) Inventors: Martin Hillbratt, Lindome (SE); Mats Höjlund, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 14/217,332

(22) Filed: Mar. 17, 2014

(65) Prior Publication Data

US 2014/0270292 A1 Sep. 18, 2014

Related U.S. Application Data

(60) Provisional application No. 61/793,602, filed on Mar. 15, 2013.

(51) Int. Cl.
*H04R 25/00* (2006.01)

(52) U.S. Cl.
CPC ..... *H04R 25/453* (2013.01); *H04R 25/606* (2013.01)

(58) Field of Classification Search
CPC ..... H04R 25/00; H04R 25/453; H04R 25/45; H04R 25/606
USPC ..... 381/312, 317, 318, 320, 321
See application file for complete search history.

(56) References Cited

U.S. PATENT DOCUMENTS

| | | | | |
|---|---|---|---|---|
| 5,402,496 | A * | 3/1995 | Soli et al. | 381/94.2 |
| 6,876,751 | B1 * | 4/2005 | Gao et al. | 381/318 |
| 7,778,426 | B2 * | 8/2010 | McDermott et al. | 381/93 |
| 8,571,243 | B2 * | 10/2013 | Komagel et al. | 381/317 |
| 2007/0269068 | A1 * | 11/2007 | Komagel et al. | 381/318 |

* cited by examiner

*Primary Examiner* — Tuan D Nguyen
(74) *Attorney, Agent, or Firm* — McDonnell Boehnen Hulbert & Berghoff LLP

(57) ABSTRACT

Systems, methods, and devices are disclosed. An example sound processor is disclosed. The example sound processor includes a module configured to identify a feedback artifact in a current sample of an input spectral component by determining that a change in a signal level of an input spectral component is approximately equal to a predicted change. The predicted change may be based on one or more characteristics of an external feedback loop. Responsive to identifying the feedback artifact, the sound processor is further configured to apply a modification to a parameter used to process the input spectral component. The modification reduces a likelihood of including audible feedback in a processed input spectral component.

20 Claims, 8 Drawing Sheets

METHODS, SYSTEMS, AND DEVICES FOR DETECTING FEEDBACK

CROSS-REFERENCE TO RELATED APPLICATION

Priority is claimed to U.S. Provisional Patent Application No. 61/793,602 filed on Mar. 15, 2013, the entire contents of which are hereby incorporated by reference.

BACKGROUND

Individuals who suffer from certain types of hearing loss may benefit from the use of a hearing prosthesis. Depending on the type and the severity of the hearing loss, an individual can employ a hearing prosthesis to assist a recipient in perceiving at least a portion of a sound. A partially implantable hearing prosthesis typically includes an external component that performs at least some processing functions and an implanted component that at least delivers a stimulus to a body part in an auditory pathway, such as a cochlea, an auditory nerve, a brain, or any other body part that contributes to the perception of sound. In the case of a totally implantable hearing prosthesis, the entire device is implanted in the body of the recipient.

SUMMARY

A sound processor is disclosed. The sound processor includes a module configured to identify a feedback artifact in a current sample of an input spectral component by determining that a change in a signal level of the input spectral component is approximately equal to a predicted change. Responsive to identifying the feedback artifact, the sound processor is further configured to apply a modification to a parameter used to process the input spectral component. The modification reduces a likelihood of including audible feedback in a processed input spectral component.

A first method is disclosed. The first method includes determining a change in an input spectral component of an input spectral signal over a period of time. The first method also includes determining that the change in the input spectral component is indicative of the input spectral component including a feedback artifact. In response to determining that the change is indicative of the input spectral component including the feedback artifact, the first method includes reducing an amount of spectral information of the input spectral component by a reduction factor. The reduced amount of spectral information is included in a processed spectral signal. Additionally, the first method includes determining that a second change in the input spectral component over a second period of time is about equal to the reduction factor, wherein the second period of time is subsequent to the first period of time A second method is disclosed. The second method includes generating an output signal that includes one or more output spectral components. The second method also includes determining that an output spectral component included in the one or more output spectral components includes audible feedback. In response to determining that the output spectral component includes audible feedback, the second method further includes adjusting a setting of a variable used to identify a feedback artifact in an input spectral component of an input signal. A frequency of the output spectral component corresponds to a frequency of the input spectral component.

The second method additionally includes using the adjusted setting to detect a feedback artifact in one or more subsequent input signals.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE FIGURES

Presently preferred embodiments are described below in conjunction with the appended drawing figures, wherein like reference numerals refer to like elements in the various figures, and wherein.

DETAILED DESCRIPTION

The following detailed description describes various features, functions, and attributes of the disclosed systems, methods, and devices with reference to the accompanying figures. In the figures, similar symbols typically identify similar components, unless context dictates otherwise. The illustrative embodiments described herein are not meant to be limiting. It will be readily understood that the aspects of the present disclosure, as generally described herein, and illustrated in the figures, can be arranged, substituted, combined, separated, and designed in a wide variety of different configurations, all of which are contemplated herein.

Figure 1A:
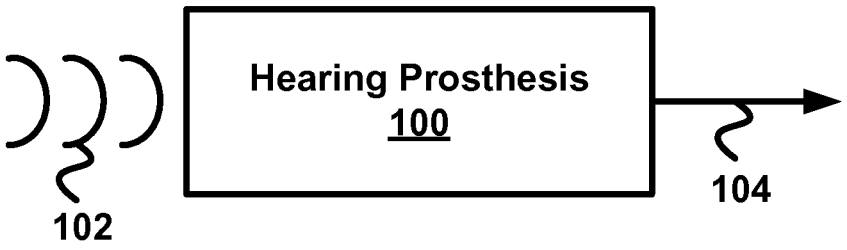
FIG. 1A is a block diagram of a hearing prosthesis, according to an example.

FIG. 1A is a block diagram of a hearing prosthesis 100. A recipient who suffers from conductive hearing loss, and possibly some sensorineural hearing loss, utilizes the hearing prosthesis 100 to assist the recipient in perceiving at least a portion of a sound 102. At a basic level, the hearing prosthesis 100 receives and processes the sound 102, and generates a stimulus 104 that is delivered to one or more body parts in an auditory pathway of the recipient.

As used herein, the term "auditory pathway" refers to body parts in a human (or other mammalian) body, such as a portion of the skull, an ossicular chain, a cochlea, and an auditory nerve, that, when stimulated, cause the recipient to perceive at least a portion of a sound. Delivering the stimulus 104 to the body part in the auditory pathway allows the recipient to perceive at least a portion of the sound 102.

In one example, the stimulus 104 is a mechanical stimulus. In this example, the hearing prosthesis 100 is a bone conduction device, a middle ear implant, or any similar hearing prosthesis now known or later developed that is configured to deliver the stimulus 104 to the recipient as a mechanical stimulus. The hearing prosthesis 100 delivers the stimulus 104 to one or more bones in the recipient's head, thereby stimulating the cochlea in the recipient's auditory pathway.

In another example, the stimulus 104 is an acoustical stimulus. In this example, the hearing prosthesis 100 is a direct acoustic stimulation device, an acoustic hearing aid, or any similar hearing prosthesis now known or later developed that is configured to deliver the stimulus 104 to the recipient as an acoustical stimulus. The hearing prosthesis 100 delivers the stimulus 104 to a body part in the recipient's middle ear, thereby stimulating the cochlea in the recipient's auditory pathway.

In yet another example, the hearing prosthesis 100 is a hybrid hearing device. For instance, the hearing prosthesis 100 may include an acoustical stimulation component, such as an acoustic speaker of a direct acoustic stimulation device, and an electrical component, such as an electrode array of a cochlear implant. In this example, the acoustical stimulation component delivers a first component of the stimulus 104 as an acoustic stimulus, and the electrical stimulation component delivers a second component of the stimulus 104 as an electrical stimulus. Other examples of hybrid hearing prostheses or hybrid hearing aids are also possible.

Because a distance between an input component (e.g., an audio transducer) and an output component (e.g., an anchor system in a bone conduction device or an acoustic actuator in a middle ear implant or an acoustic hearing prosthesis) of the hearing prosthesis 100 is typically no greater than several centimeters, the hearing prosthesis 100 is susceptible to feedback. Feedback can cause the recipient to perceive a tone at one or more frequencies. Feedback can potentially inhibit the recipient's ability to perceive sounds and, in some situations, may cause additional damage to the recipient's hearing. In some situations, feedback can also damage one or more components of the hearing prosthesis 100.

Figure 1B:
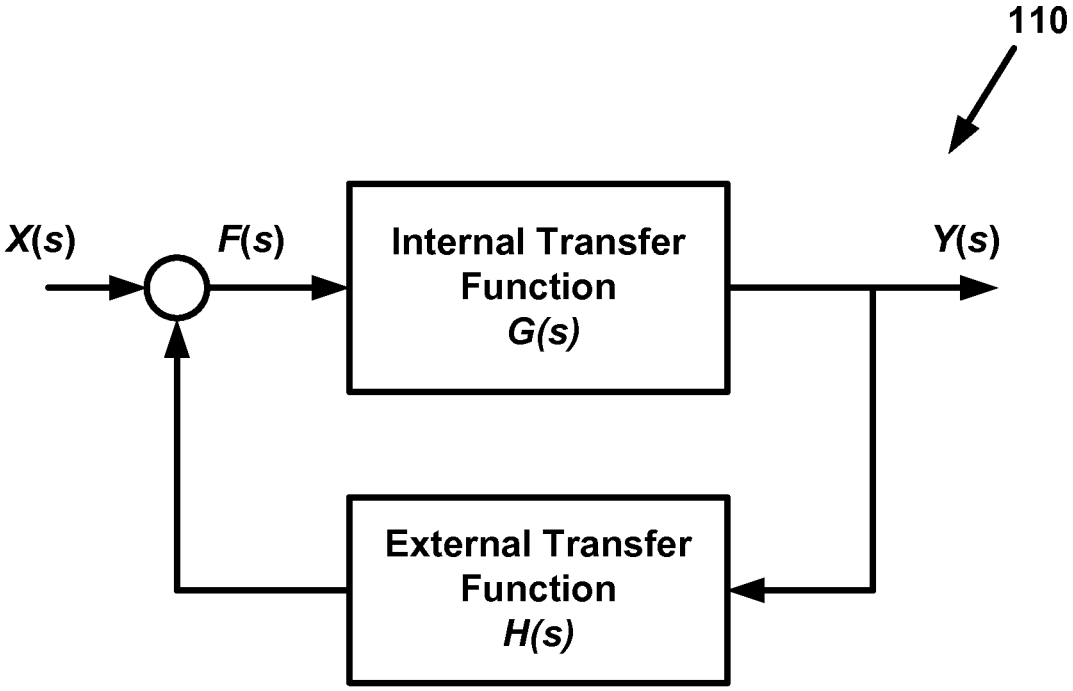
FIG. 1B is a functional block diagram of an external feedback system that includes the hearing prosthesis depicted in FIG. 1A, according to an example.

FIG. 1B is a block diagram of an external feedback system 110. The external feedback system 110 represents one example of an external feedback loop that occurs when the hearing prosthesis 100 processes the sound 102. In FIG. 1B, the sound 102 and the stimulus 104 are mathematically represented as a transformed sound X(s) and a transformed stimulus Y(s), respectively.

The hearing prosthesis 100 receives a transformed input signal F(s). Due to external feedback, the transformed input signal F(s) includes the transformed sound X(s) and a portion of the transformed stimulus Y(s). Accordingly, the transformed input signal F(s) is given by the following equation:

$$F(s)=X(s)+Y(s)\cdot H(s)$$

where H(s) is an external transfer function of the external feedback system 110. The hearing prosthesis 100 processes the input signal F(s) such that the transformed stimulus Y(s) is given by the following equation:

$$Y(s)=F(s)\cdot G(s)=\frac{X(s)\cdot G(s)}{1-H(s)\cdot G(s)}$$

where G(s) is an internal transfer function of the hearing prosthesis 100. In the external feedback system 110, audible feedback occurs when the transformed stimulus Y(s) becomes unstable (i.e., approaches infinity).

Additionally, the transformed stimulus Y(s) depends on an internal time delay $td_1$ and an external time delay $td_2$. The internal time delay $td_1$ is due to delays associated with one or more components of the hearing prosthesis 100 used to process and generate the transformed stimulus Y(s). The external time delay $td_2$ is due to propagation of the transformed stimulus Y(s) through the one or more media. Accounting for the time delays $td_1$, $td_2$ results in the following equation:

$$Y(s)=\frac{e^{-s\cdot td_1}H(s)}{1-e^{-s\cdot td_2}G(s)\cdot e^{-s\cdot td_1}H(s)}\cdot X(s)$$

In the time domain, the following equations express the relationship between the input signal f(t) received by the hearing prosthesis 100 and the stimulus 104 represented as a time-domain function y(t):

$$f(t)=x(t)+y(t-td_2)\cdot \mathrm{H}$$

$$y(t)=x(t-td_1)\cdot G$$

where x(t) is the sound 102 expressed as a time domain function, H is a frequency dependent attenuation factor of the external feedback system 110, and G is a frequency dependent amplification factor of the hearing prosthesis 100.

To reduce a likelihood of including feedback in the stimulus 104, the hearing prosthesis 100 is configured to identify an indication of feedback in the transformed input signal F(s) at one or more frequencies. Identifying an indication of feedback in the transformed input signal F(s) may allow the hearing prosthesis 100 to reduce, or possibly suppress, a feedback artifact prior to the feedback artifact rising to an audible level, thereby enhancing the recipient's experience and ability to perceive sounds. Additionally, identifying feedback artifacts in the input signal F(s) may require less computing power as compared to traditional feedback filtering, thereby conserving power.

The hearing prosthesis 100 may identify a feedback artifact in the transformed input signal F(s) at each of one or more frequencies by determining one or more changes in signal levels (i.e., frequency-dependent energy) of the transformed input signal F(s) at one or more time intervals. Since feedback may build in one or more frequency components of the transformed input signal F(s) at different rates, a difference in the one or more times is frequency dependent. That is, the hearing prosthesis 100 may determine the one or more changes in the transformed input signal F(s) for a first frequency channel at an interval that is different than an interval for a second frequency channel.

In one example, the hearing prosthesis 100 identifies an indication of feedback building in the transformed input signal F(s) at a given frequency by comparing a change in the signal level of the transformed input signal F(s) at that frequency to a threshold change. The threshold change represents an increase in the transformed input signal F(s) at a given frequency that is indicative of feedback building in the transformed input signal F(s) at the frequency. If the change is greater than or equal to the threshold change, the hearing prosthesis 100 determines that transformed input signal F(s) includes an indication of feedback at the frequency.

In another example, the hearing prosthesis 100 identifies an indication of feedback building the transformed input signal F(s) by determining a trend in the signal level of the transformed input signal F(s) at one or more frequencies. Unlike most sounds originating from a source in an environment, feedback generally increases at an approximately exponential rate. Consequently, feedback may cause the signal level of the input signal F(s) at some frequencies to increase faster than the sound 102. That is, since many sounds originating in an environment are slow-varying, the hearing prosthesis 100 determines that a rapid and/or exponential increase in the signal level of the input signal F(s) in one or more frequency channels is indicative of feedback in the one or more frequency channels. If the trend in differences is approximately exponential at one or more frequencies, the hearing prosthesis 100 determines that input signal F(s) includes an indication of feedback at the one or more frequencies.

In response to identifying an indication of feedback, the hearing prosthesis 100 is configured to verify that the input signal F(s) includes feedback at one or more frequencies. The hearing prosthesis 100 verifies each indication of feedback by applying a reduction factor to the internal amplification factor G for each frequency in which an indication of feedback is identified. The hearing prosthesis 100 then determines if a subsequent change is about equal to a predicted change, which is about the same as the reduction factor applied to the amplification factor G for each frequency. If the change is about equal to the predicted change at a given frequency, the hearing prosthesis 100 confirms that there is a feedback artifact in the input signal F(s) at that frequency. The hearing prosthesis 100 then modifies one or more parameters used to generate the transformed stimulus Y(s) at that frequency to reduce the likelihood of audible feedback being included in the output signal Y(s).

In order to enable the hearing prosthesis 100 to identify an indication of feedback in the input signal F(s), one or more feedback characteristics are determined for one or more of the frequency channels of the hearing prosthesis 100. The one or more feedback characteristics may include the attenuation factor H of the external feedback system 110, the internal time delay $td_1$ of the hearing prosthesis 100, and the external time delay $td_2$ of the external feedback system 110 for each of the one or more frequency channels.

When the hearing prosthesis 100 is calibrated, or "fit," to the recipient, the one or more feedback characteristics may be measured. Additionally, the threshold change and/or the predicted change for each of the one or more frequency channels is calculated or otherwise determined based on the one or more feedback characteristics.

In one example, the hearing prosthesis 100 does not identify an indication of feedback prior to feedback rising to an audible level. For instance, if the recipient has entered a new acoustic environment or a characteristic of a current acoustic environment has changed, the measured feedback characteristics for one or more of the frequency channels may no longer be suitable for detecting an indication of feedback. In this example, the hearing prosthesis 100 is configured to modify a value, such as a threshold change and/or a predicted change at one or more frequencies, in response to determining that the output signal Y(s) includes audible feedback.

Figure 2:
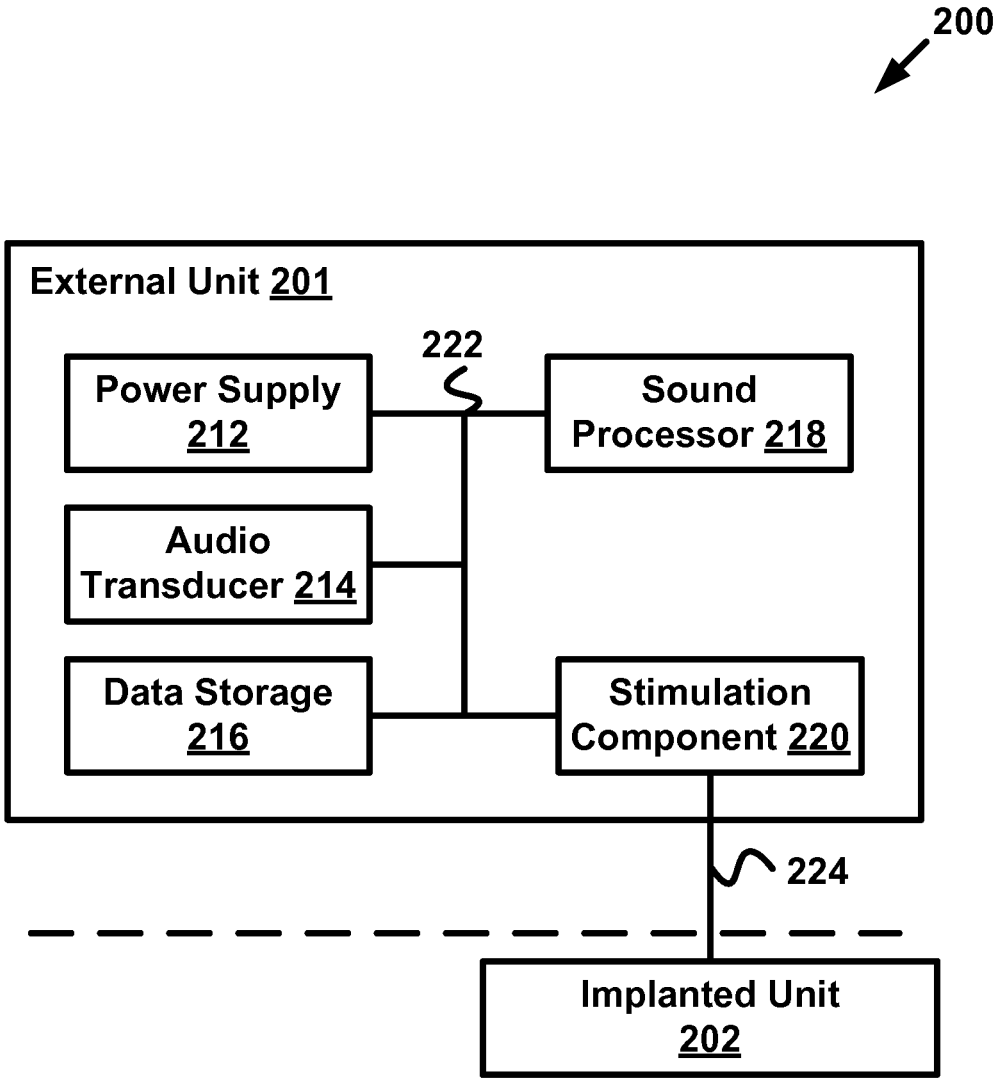
FIG. 2 is a block diagram of the hearing prosthesis depicted in FIG. 1A, according to an example.

FIG. 2 is a block diagram of a hearing prosthesis 200. The hearing prosthesis 200 is one example of the hearing prosthesis 100. The hearing prosthesis 200 includes an external unit 201 and an implanted unit 202. The external unit 201 includes a power supply 212, an audio transducer 214, a data storage 216, a sound processor 218, and a stimulation component 220, all of which are connected either directly or indirectly via circuitry 222. The implanted unit 202 is connected to the stimulation component 220 via a link 224.

In one example, the hearing prosthesis 200 is a partially implantable hearing prosthesis, such as a bone conduction device. In this example, the implanted unit 202 is implanted in a body of the recipient of the hearing prosthesis 200, and the external unit 201 is contained in a single enclosure (or possibly multiple enclosures) that the recipient wears externally on the recipient's body. In another example, the hearing prosthesis 200 is a totally implantable hearing prosthesis. In this example, the external unit 201 and the implanted unit 202 are both implanted in the recipient's body, perhaps in a single enclosure.

The power supply 212 supplies power to various components of the hearing prosthesis 200 and can be any suitable power supply, such as a rechargeable or non-rechargeable battery. In one example, the power supply 212 is a battery that can be charged wirelessly, such as through inductive charging.

The audio transducer 214 receives a sound from an environment and sends a sound signal to the sound processor 218. In one example, the hearing prosthesis 200 is a bone conduction device, and the audio transducer 214 is an omnidirectional microphone.

In another example, the hearing prosthesis 200 is a direct acoustic stimulation device, a middle ear implant, an acoustic hearing aid, or any other vibration-based hearing prosthesis now known or later developed that is suitable for assisting a user of the hearing prosthesis 200 in perceiving sound. In this example, the audio transducer 214 is an omnidirectional microphone, a directional microphone, an electro-mechanical transducer, or any other audio transducer now known or later developed suitable for use in the type of hearing prosthesis employed. Furthermore, in other examples the audio transducer 214 includes one or more additional audio transducers.

The data storage 216 includes any type of non-transitory, tangible, computer readable media now known or later developed configurable to store program code for execution by the hearing prosthesis 200 and/or other data associated with the hearing prosthesis 200. The data storage 216 stores control settings and variable settings usable by the sound processor 218 to process a sound. The data storage 216 also stores information usable by the sound processor 218 to identify an indication of feedback. The data storage 216 may additionally store computer programs executable by the sound processor 218, such as computer programs that cause the sound processor 218 to perform one or more steps of the methods described herein with respect to FIGS. 5A-7.

The sound processor 218 receives a sound signal from the audio transducer 214 and processes the sound signal into a processed signal suitable for use by the stimulation component 220. In one example, the sound processor 218 is a digital signal processor. In another example, the sound processor 218 is any processor or combination of processors now known or later developed suitable for use in a hearing prosthesis. Additionally, the sound processor 218 may include additional hardware for processing the sound signal, such as an analog-to-digital converter.

The sound processor 218 determines the processed signal by processing the sound signal received from the audio transducer 214. The processed signal includes information usable by the stimulation component 220 to generate a stimulation signal. In one example, the sound processor 218 processes the sound signal as described herein with respect to FIG. 3. Additionally, the sound processor 218 accesses the data storage 216 to retrieve one or more parameters used to generate the processed signal. In one example, the sound processor 218 also accesses the data storage 216 to retrieve one or more computer programs that cause the sound processor 218 to execute at least a portion of the methods described herein with respect to FIGS. 5A-7.

The stimulation component 220 receives the processed signal from the sound processor 218 and generates a stimulation signal based on the processed signal. The stimulation signal includes information usable by the implanted unit 202 to generate the stimulus at one or more frequency channels.

In an example in which the hearing prosthesis 200 is a bone conduction device, the stimulation component 220 generates one or more stimulation signals that include information for generating a stimulus as a mechanical output force in the form of a vibration. In an example in which the hearing prosthesis 200 is a middle ear implant or similar acoustic hearing aid/prosthesis, the stimulation component 220 generates one or more stimulation signals that include information for generating a stimulus as an acoustic output in the form of one or more sound waves. In another example, the stimulation component 220 generates a stimulation signal that includes information suitable for generating a stimulus capable of allowing the recipient to perceive at least a portion of a sound.

The implanted unit 202 receives the stimulation signal from the stimulation component 220 via the link 224. In an example in which the hearing prosthesis 200 is a partially implantable hearing prosthesis, the link 224 is a transcutaneous link or a percutaneous link. Additionally, the link 224 may be a wired link or a wireless link.

The implanted unit 202 generates a stimulus based on the stimulation signal and delivers the stimulus to a body part in an auditory pathway of the recipient. In an example in which the hearing prosthesis 200 is (or simulates) a bone conduction device, the implanted unit 202 includes an anchor system. The anchor system delivers the stimulus to the user in the form of a vibration applied to a bone in the recipient's skull. The vibration causes fluid in the recipient's cochlea to move, thereby activating hair cells in the recipient's cochlea. The hair cells stimulate an auditory nerve, which allows the recipient to perceive at least a portion of a sound.

In another example, the hearing prosthesis 200 is a direct acoustic stimulation device, a middle ear implant, an acoustic hearing aid, or any other hearing prosthesis now known or later discovered that is configured to deliver a stimulus as a mechanical force or an acoustic output. In this example, the implanted unit 202 delivers a mechanical stimulus, an acoustical stimulus, and/or any other stimulus or combination of stimuli capable of stimulating the body part in the recipient's auditory pathway that allows the recipient to perceive at least a portion of a sound.

Figure 3:
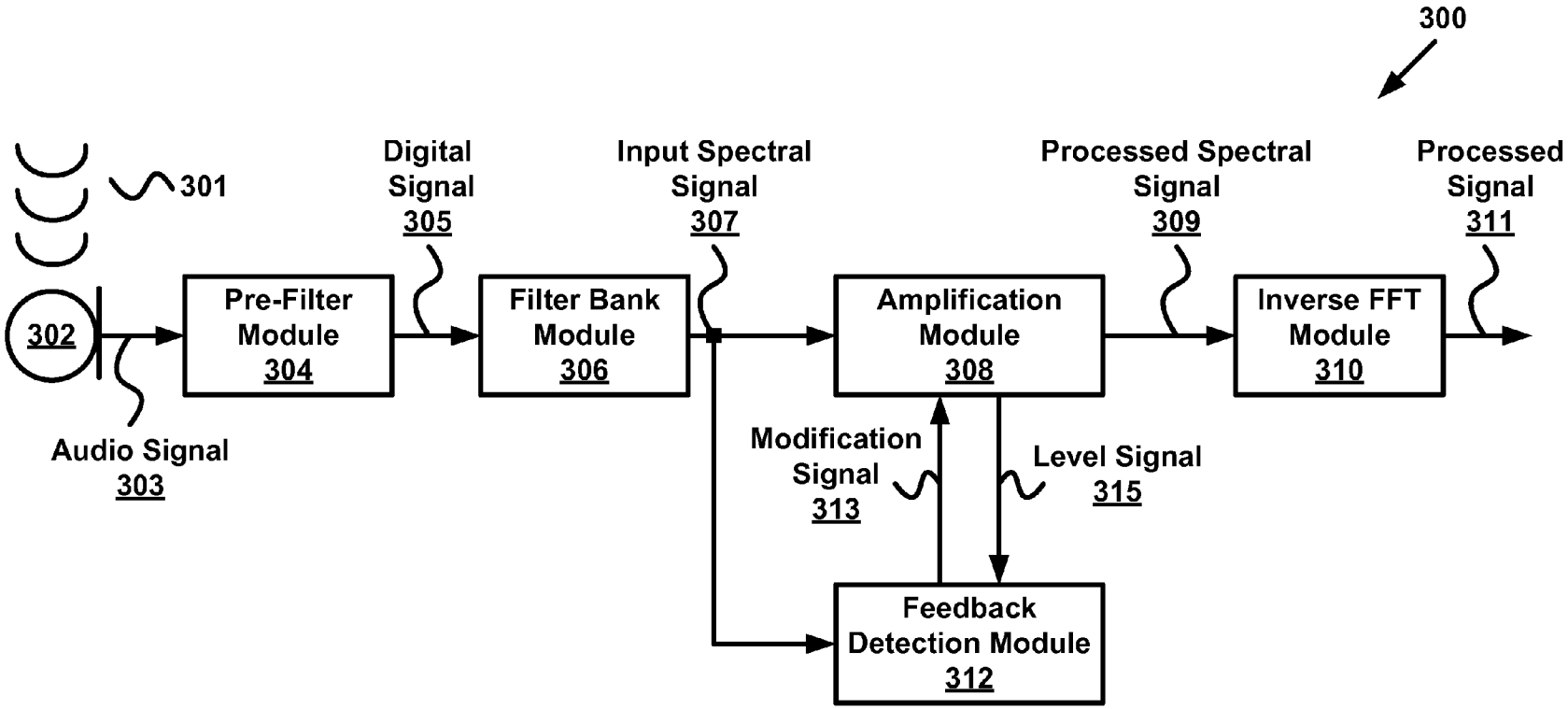
FIG. 3 is a block diagram of a system for processing an audio signal, according to an example.

FIG. 3 is a block diagram of a system 300 for processing an audio signal. The system 300 includes an audio transducer 302, a pre-filter module 304, a filter bank module 306, an amplification module 308, an inverse FFT module 310, and a feedback detection module 312. While the system 300 is described with reference to the hearing prostheses 100 and 200, it is understood that other or additional devices may also be used.

In one example, the sound processor 218 includes hardware and/or software configurable to perform the operations described with respect to the modules 304-312. In another example, the external unit 201 includes one or more additional components configured to assist the sound processor 218 in performing the operations described with respect to the modules 304-312. For instance, if the sound processor 218 performs the operations described with respect to modules 306-312, the external unit 201 includes an additional component configured to perform the operations described with respect to the pre-filter module 304.

The audio transducer 302 receives a sound 301 from the environment. The audio transducer 302 is the same as or is substantially similar to the audio transducer 214. The audio transducer 302 sends an audio signal 303 that includes information indicative of the sound 301 to the pre-filter module 304.

The pre-filter module 304 includes an amplifier configured to amplify the audio signal 303 in preparation for processing. The pre-filter module 304 also includes an analog-to-digital converter suitable for digitizing the audio signal 303. In one example, the analog-to-digital converter uses a sampling rate of 16 kHz to generate a 16-bit digital signal. In another example, a different sampling rate and/or bit representation is used when digitizing the audio signal 303.

The output of the pre-filter module 304 is a digital signal 305. The filter bank module 306 receives the digital signal 305 and generates an input spectral signal 307 that includes one or more input spectral components of a sample of the digital signal 305. An input spectral component of the digital signal 305 is a signal level of the digital signal 305 at a corresponding frequency channel. The signal level corresponds to an amount of energy in the digital signal 305 at a range of frequencies corresponding to the frequency channel. In one example, the signal level of the digital signal 305 at each frequency channel corresponds to a sound pressure level (SPL) of the sound 301 at a frequency corresponding to the frequency channel.

The filter bank module 306 is configured to transform each sample of the digital signal 305 to a frequency domain signal using a Fast Fourier Transform (FFT). The filter bank module 306 is also configured to generate an envelope for each frequency channel of the hearing prosthesis 100. Each envelope includes energy from one or more FFT bins. Based on each envelope, the filter bank module 306 generates an input spectral component of the digital signal 305. In one example, the signal level of an input spectral component is a maximum value of the envelope in a corresponding frequency channel. In another example, the signal level is an average of the energy level of the envelope. Other examples may also be possible. The filter bank module 306 combines the input spectral components to provide the input spectral signal 307.

The amplification module 308 is configured to provide a processed signal 309 by amplifying each of the input spectral components included in the input spectral signal 307. The amplification module 308 amplifies and performs additional processing on each of the one or more input spectral component to provide one or more processed spectral components. The amplification module 308 includes each processed spectral component in the processed spectral signal 309.

Amplifying the input spectral components shapes the spectral envelopes to accommodate the recipient's personal sensitivity and/or hearing loss at each frequency corresponding to a frequency channel. A gain for each frequency channel is determined when the recipient is fitted with the hearing prosthesis 200 and may be stored in the data storage 216. The amplification module 308 may also employ adaptive gain control for each frequency channel to improve the recipient's perception of the sound 301.

In one example, the amplification module 308 includes a compressor (not shown) for each frequency channel. In this example, the compressor is used to provide non-linear compression for each frequency channel. Compressing each spectral component may smooth natural changes in the signal level of input spectral components (i.e., changes not due to feedback), thereby allowing the recipient to perceive changes in a loudness of the sound 301 more like a person with normal hearing.

In another example, the amplification module 308 includes a noise reduction module (not shown) configured to reduce an amount of noise in each input spectral component. In yet another example, the amplification module 308 includes one or more additional components configured to process the input spectral signal 307 to provide the processed spectral signal 309.

The inverse FFT module 310 receives the processed spectral signal 309 and generates a processed signal 311. The processed signal 311 is a time domain signal usable by the stimulation component 220 to generate the stimulus 104. The inverse FFT module 310 extracts the signal level from each processed spectral component included in the processed spectral signal 309 and generates a number of FFT bins. Once the FFT bins are generated, the inverse FFT module 310 performs an inverse FFT to generate the processed signal 311.

The feedback detection module 312 receives the input spectral signal 307 from the filter bank module 306 and identifies an indication of feedback in one or more input spectral components. More particularly, the feedback detection module 312 is configured to determine whether a change in the signal level of an input spectral component is indicative of feedback building in that input spectral component.

In one example, the feedback detection module 312 determines the change in the signal level of the input spectral component in two successive samples of the input spectral signal 307. A method for identifying an indication of feedback in an input spectral component based on the change of the spectral component in the signal level is discussed herein with respect to FIG. 5A. In another example, the feedback detection module 312 determines a trend in the signal level of the input spectral component over a period of time. A method for identifying an indication of feedback in an input spectral component based on the trend in the signal level of the spectral component is described herein with respect to FIG. 5B.

Upon identifying an indication of feedback in a spectral component, the feedback detection module 312 is configured to verify that feedback is building in the input spectral component. The feedback detection module 312 generates a modification signal 313, which includes information indicative of one or more input spectral components (or, alternatively, one or more frequency channels) in which the feedback detection module has identified an indication of feedback.

In response to receiving the modification signal 313, the amplification module 308 reduces the gain applied to each spectral component identified in the modification signal 313 by a reduction factor. For a given frequency channel, the reduction factor is selected so as to allow the feedback detection module 312 to verify that feedback is building in an input spectral component without overly attenuating the information indicative of a portion of the digital signal 305 included in the spectral component. In one example, the reduction factor is about the same for each spectral component, such as about −2 dB. In another example, the value of the reduction factor is frequency dependent. In this example, the value of the reduction factor for each spectral component varies to account for differences in the attenuation factor H at one or more frequencies.

After sending the modification signal 313 to amplification module 308, the feedback detection module 312 verifies whether a feedback artifact is included in one or more of the input spectral components. For each input spectral component in which the feedback detection module 312 identified feedback, the feedback detection module 312 determines a change in the signal level of the input spectral component after the gain for that channel is reduced by the reduction factor.

For instance, consider an example in which the feedback detection module 312 identifies an indication of feedback in the input spectral component corresponding to the Cth frequency channel. In this example, the feedback detection module 312 identified the indication of feedback at a first time $t_1$. To verify that feedback is building in the Cth frequency channel, the feedback detection module 312 determines the change in the signal level of the input spectral component between the first time $t_1$ and a second time $t_2$. In one example, a difference between the first time $t_1$ and the second time $t_2$ is about the same as the external time delay $td_2$ for the Cth frequency channel.

The feedback detection module 312 determines whether the change in the input spectral component between the first time $t_1$ and the second time $t_2$ is approximately equal to a predicted change. The predicted change accounts for a change in a feedback artifact caused by applying the reduction factor to the gain at the first time $t_1$, and for a change in the feedback artifact cause by the external attenuation factor H for a given frequency.

In one example, the predicted change is a range of values within a tolerance of the reduction factor. For instance, if the reduction factor for the Cth frequency channel is −2 dB, the predicted change may be −2 dB+/−0.5 dB. In this example, if the change in the signal level of the input spectral component is about equal to −2 dB+/−0.5 dB, the feedback detection module 312 determines that there is a feedback artifact in the input spectral component corresponding to the Cth frequency channel. In another other examples, the predicted change is range of values within a tolerance of the reduction factor that is greater than or less than about +/−0.5 dB. For instance, the tolerance may be about +/−2 dB or greater.

FIGS. 4A-4D illustrate an example in which the feedback detection module 312 identifies feedback in one or more input spectral components included in the input spectral signal 307. Each of the graphs depicts the signal level of each of eight input spectral components $F_1$-$F_8$ included in the input spectral signal 307. While the input spectral signal 307 is described as having the eight input spectral components $F_1$-$F_8$, it is understood that the input spectral signal 307 may have more or fewer input spectral components.

Figure 4A:
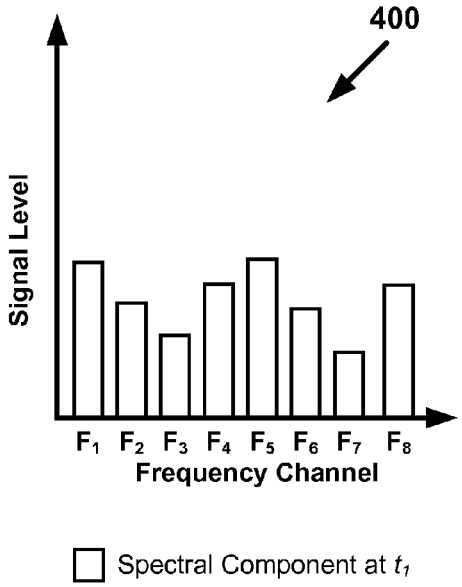
FIGS. 4A-4D are graphs of input spectral signals, according to an example.
Figure 4B:
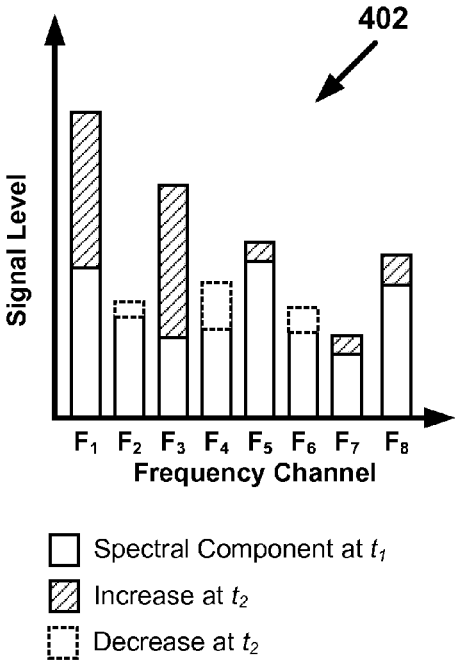

FIG. 4A is a graph 400 of the input spectral signal 307 at a first sample time $t_1$. FIG. 4B is a graph 402 of the input spectral signal 307 a second time $t_2$. To illustrate the change in the signal levels of the input spectral components $F_1$-$F_8$, the graph 402 also includes an indication of the input spectral signal 307 at the first time $t_1$. In the graph 402, the signal levels for the first input spectral component $F_1$, the third spectral component $F_3$, the fifth spectral component $F_5$, the seventh spectral component $F_7$, and the eighth spectral component $F_8$ have increased at the second time $t_2$. Additionally, the second spectral component $F_2$, the fourth spectral component $F_4$, and the sixth spectral component $F_6$ have decreased at the second time $t_2$.

In this example, the signal levels for the first input spectral component $F_1$ and the third input spectral component $F_3$ have increased more than the other spectral components $F_5$, $F_7$, $F_8$. In this example, the feedback detector 312 identifies indications of feedback building in both the first input spectral component $F_1$ and the third input spectral component $F_3$, perhaps by implementing one or more steps of the methods described herein with respect to FIGS. 5A-6.

Figure 4C:
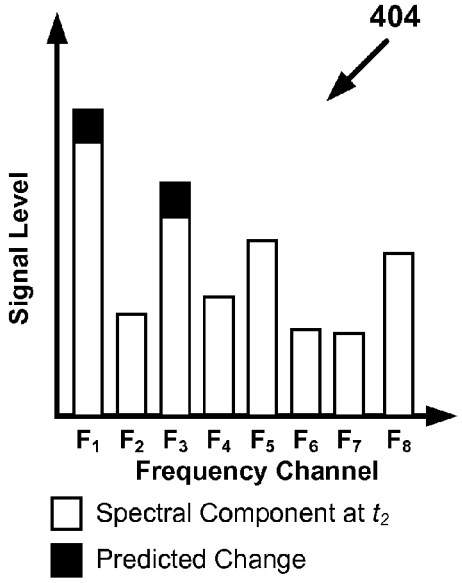

FIG. 4C is a graph 404 of the input spectral signal 307 at the second time $t_2$. The graph 404 also includes an indication of the reduction factor applied to the first input spectral component $F_1$ and the third input spectral component $F_3$ at the second time $t_2$. While the reduction factor for the first input spectral component $F_1$ and the reduction factor for the third input spectral component $F_3$ is about the same, the reduction factors may vary for the input spectral components $F_1$-$F_8$, as previously explained.

Figure 4D:
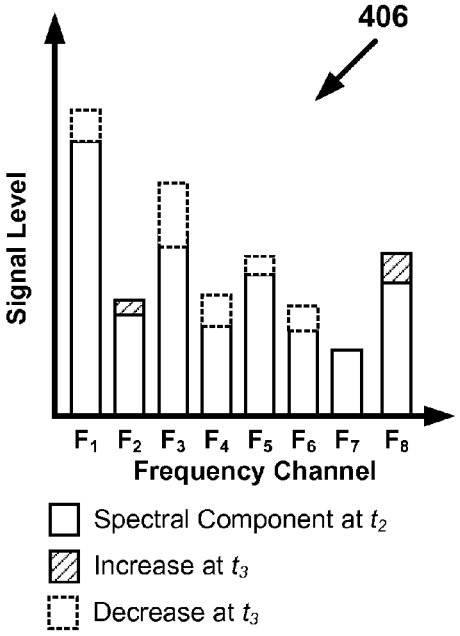

FIG. 4D is a graph 406 of the input spectral signal 307 at a third time $t_3$. The time $t_3$ occurs after the amplification module 308 has applied the reduction factors to the gains of the first spectral component $F_1$ and the third spectral component $F_3$. To illustrate the change the signal levels for the input spectral components $F_1$-$F_8$, the graph 406 also includes an indication of the input spectral signal 307 at the second time $t_2$.

As depicted in the graph 406, the signal levels for the second spectral component $F_2$ and the eighth spectral component $F_8$ have increase at the third time $t_3$, and the signal level for the seventh spectral component $F_7$ is about unchanged at the third time $t_3$. Additionally, the first input spectral component $F_1$, the third spectral component $F_3$, the fourth spectral component $F_4$, the fifth spectral component $F_5$, the sixth spectral component $F_6$, the seventh spectral component $F_7$, and the eighth spectral component $F_8$ have decrease at the third time $t_3$.

In this example, the feedback detection module 312 determines that the change for first input spectral component $F_1$ is about the equal to the predicted change, indicating that feedback is building in the first input spectral component $F_1$. Consequently, the feedback detection module 312 has verified that feedback is building in the first input spectral component $F_1$. The feedback detection module 312 also determines that, while the third input spectral component $F_3$ decreased from second time $t_2$ to the time $t_3$, the change is not about equal to the predicted change. In this case, the feedback detection module 312 does not verify that feedback is building in the third input spectral component $F_3$.

Upon verifying that feedback is building in one or more input spectral components, the feedback component 312 causes one or more components of the system 300 to suppress the feedback. By identifying the indication of feedback in the input spectral components, the one or more components of the system 300 may reduce the signal level of the feedback artifact(s) prior to the feedback becoming audible.

In one example, the feedback detection module 312 does not identify an indication of feedback in an input spectral component prior to audible feedback being included in a processed spectral component of the processed spectral signal 309. This may be caused by a change in the external feedback path, such as a change in the acoustic environment and/or a change in a mechanical feedback path (e.g., the recipient puts on a hat, leans against a wall, etc.). In this example, the feedback detection module 312 is configured to determine whether audible feedback is included in one or more processed spectral components.

The feedback detection module 312 receives the level signal 315 from the amplification module 308. The level signal 315 includes information indicative of a signal level of one or more processed spectral components included in the processed spectral signal 309. Because feedback increases exponentially, an audible feedback artifact in an input spectral component can cause a signal level of a corresponding processed spectral component to reach a maximum output level. In one example, the feedback detection module 308 determines whether a signal level of one or more of the processed spectral components is at a maximum output level to determine if one or more of the processed spectral components includes an indication of audible feedback. If the feedback detection module 312 determines that a signal level of a processed spectral component is at the maximum output level, the feedback detection module 312 determines that the processed spectral component includes an indication of audible feedback.

In response to determining that an indication of audible feedback is included in one or more processed spectral components, the feedback detection module 312 determines a trend in the signal level of one or more corresponding input spectral components. If a trend is indicative of feedback, the feedback detection module 312 is configured to be trained to adjust the threshold change(s) used to identify an indication of feedback in one or more corresponding input spectral components. A method for training the feedback detection module 312 is described herein with respect to FIG. 7.

Figure 5A:
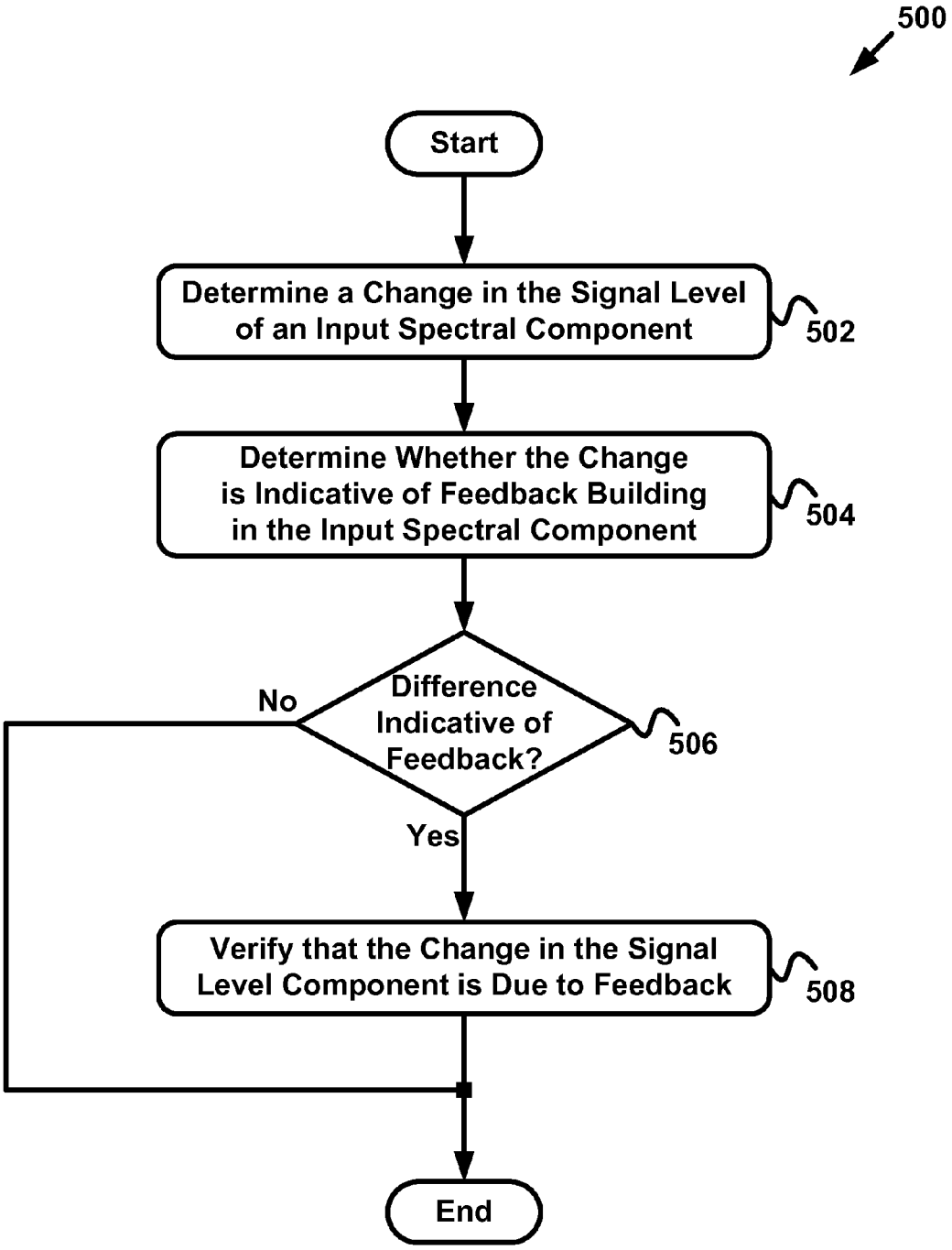
FIG. 5A is a flow diagram of a method for identifying feedback in an audio signal, according to first example.

FIG. 5A is a flow diagram of a method 500. A sound processor employs the steps of the method 500 to identify an indication of feedback in an input spectral component of an audio signal. While the hearing prosthesis 200 and the system 300 are described for purposes of illustrating the method 500 and other methods herein, it is understood that other devices may be used.

The sound processor 218 performs the steps of the method 500 for each of the M frequency channels. In one example, a frequency at which the sound processor 218 performs the steps of the method 500 depends on the external time delay $td_2$ associated with each frequency channel. For instance, the sound processor 218 performs the steps of the method 500 for the Cth frequency channel that is less than or equal to the external time delay $td_2$ for the Cth frequency channel.

In another example, the sound processor 218 performs the steps of the method 500 for each of the M frequency channels at a standard time interval. The standard time interval is less than or equal the shortest external time delay $td_2$ for the M frequency channels and is less than a highest feedback path latency.

Additionally, for the method 500 and other methods described herein, the methods are described with respect to an input spectral component corresponding to the Cth frequency channel. The Cth frequency channel is any one of the M frequency channels of the hearing prosthesis 200. Furthermore, a change in the signal level of a spectral component is positive when the signal level of the input spectral component at a second time $t_2$ is greater than signal level of the input spectral component at a first time $t_1$, with the first time $t_1$ preceding the second time $t_2$.

At block 502, the method 500 includes determining a change in a signal level of an input spectral component included in a spectral signal. The sound processor 218 determines the change in the signal level of the input spectral component by subtracting the signal level at the first time $t_1$ from the signal level at the second time $t_2$.

At block 504, the method 500 includes determining whether the change is indicative of feedback building in the input spectral component. In one example, the sound processor 218 accesses the data storage 216 to identify the threshold change for the Cth frequency channel. If the change is greater than or equal to the threshold change, the sound processor 218 determines that the change is indicative of feedback building in the input spectral component. Otherwise, the sound processor 218 determines that the change is not indicative of the feedback building in the input spectral component.

At block 506, the method 500 includes a decision point. If the change is not indicative of the feedback building in the input spectral component, the method 500 ends.

If the change is indicative of feedback building in the input spectral component, the method 500 includes verifying that the change in the signal level is due to feedback, at block 508. In one example, the sound processor 218 performs one or more blocks of the method 600 to verify that the change in the signal level is due to feedback. After performing the block 508, the method 500 ends.

Figure 5B:
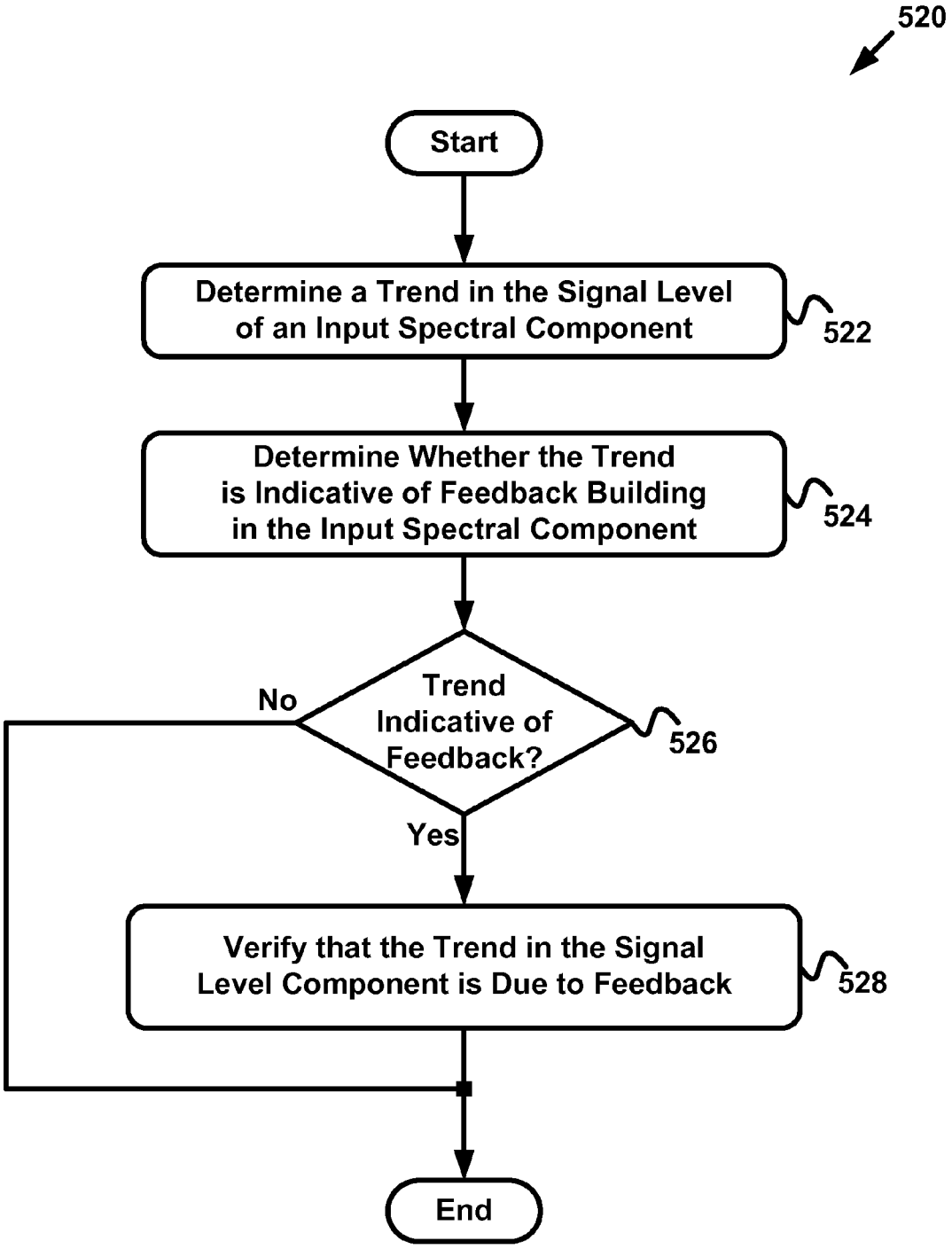
FIG. 5B is a flow diagram of a method for identifying feedback in an audio signal, according to a second example.

FIG. 5B is a flow diagram of a method 520. A sound processor employs the steps of the method 520 to identify an indication of feedback in an input spectral component of an audio signal.

In one example, the sound processor 218 performs the method 520 as an alternative to performing the method 500. In another example, the sound processor 218 performs the method 520 to identify an indication of feedback in a first set of input spectral components, such as one or more high frequency spectral components, and performs the method 500 to identify an indication of feedback in a second set of input spectral components, such as one or more low frequency spectral components. Additionally, the time interval at which the sound processor 218 performs the method 520 is the same as or is substantially similar to the time interval described with respect to the method 500.

At block 522, the method 520 includes determining a trend in the signal level of an input spectral component. In one example, the sound processor 218 determines a trend using a known method, such as an ARMA/ARMAX model, Kalman filter, or a Morawetz estimate. In this example, the sound processor 218, or perhaps a different component of the hearing prosthesis 200 implementing one or more of the modules of the system 300, predicts a change in the input signal level based on N previous input signals, where N is an integer greater than one.

In another example, the sound processor 218 determines a number of changes between successive samples of the input spectral component. For instance, the sound processor 218 determines a first input difference at a first time $t_1$, a second input difference at the second time $t_2$, and a third input difference at the third time $t_3$. Each of the times $t_1$-$t_3$ correspond to a successive sample of the input spectral signal 307, with the first time $t_1$ preceding the second time $t_2$, and the second time $t_2$ preceding the third time $t_3$.

At block 524, the method 520 includes determining whether the trend is indicative of feedback building in the input spectral component. In an example in which the input spectral component is based on a logarithmic amplitude scale, feedback causes the signal level of the input spectral component to increase at an approximately linear rate. In this example, the sound processor 218 determines whether the trend in amplitudes is approximately linear on a logarithmic amplitude scale. If the trend is approximately linear, the sound processor 218 determines that trend is indicative of feedback building in the input spectral component. If the trend is not approximately linear, the sound processor 218 determines that trend is not indicative of feedback building in the input spectral component.

In an example in which the input spectral component is based on a linear amplitude scale, feedback causes the signal level of the input spectral component to increase at an approximately exponential rate. In this example, the sound processor 218 determines whether the trend in amplitudes is approximately exponential on the linear amplitude scale. If the trend is approximately exponential, the sound processor 218 determines that trend is indicative of feedback building in the input spectral component. If the trend is not approximately exponential, the sound processor 218 determines that trend is not indicative of feedback building in the input spectral component.

At block 526, the method 520 includes a decision point. If the trend is not indicative of feedback building in the input spectral component, the method 520 ends.

If the trend is indicative of feedback building in the input spectral component, the method 520 includes verifying that the trend in the signal level is due to feedback, at block 528. In one example, the sound processor 218 performs one or more blocks of the method 600 to verify that the change in the signal level is due to feedback. After performing the block 528, the method 520 ends.

Figure 6:
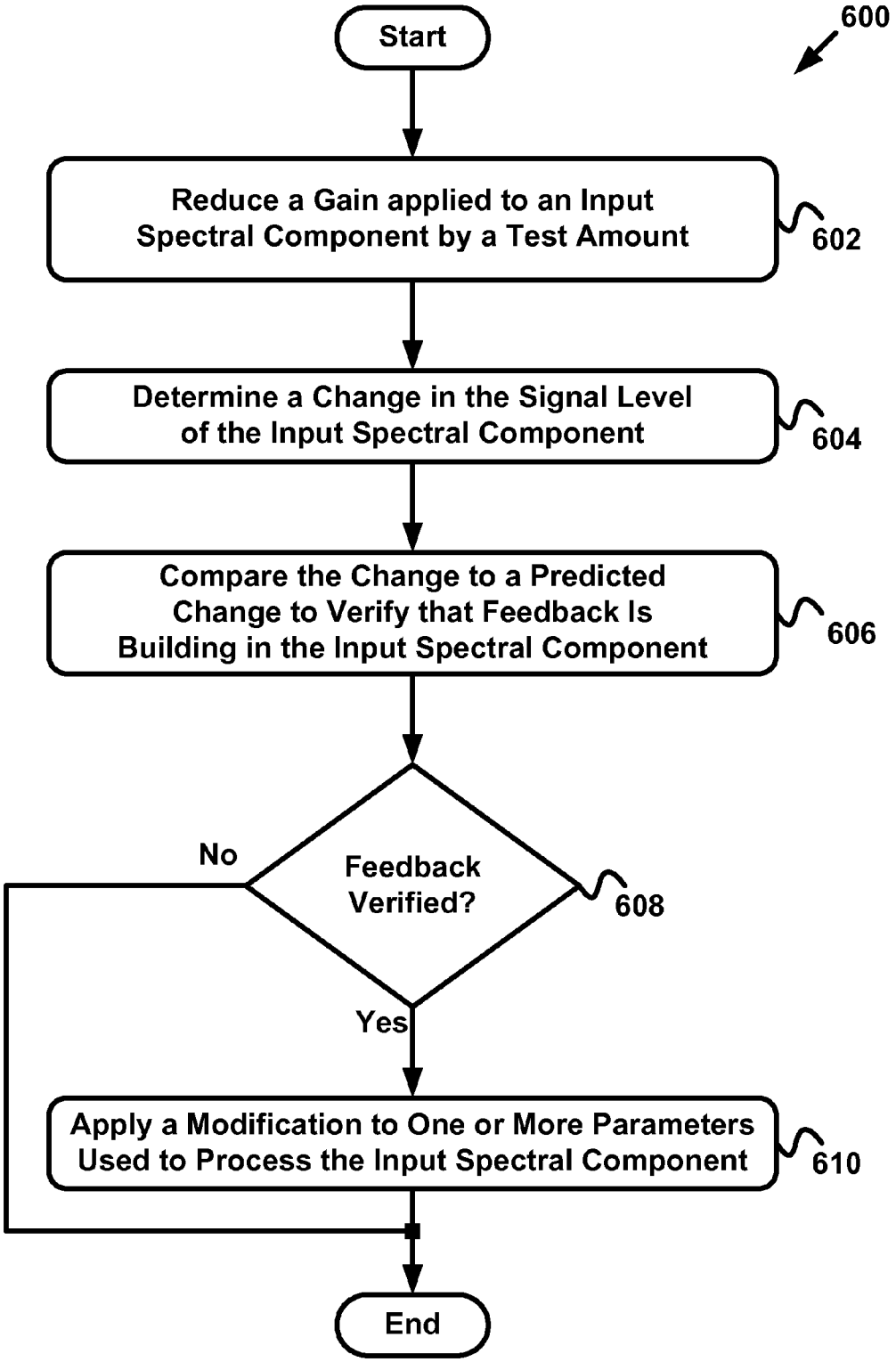
FIG. 6 is a flow diagram of a method for confirming that an input spectral component includes a feedback artifact, according to an example.

FIG. 6 is a flow diagram of a method 600. A sound processor performs one or more blocks of the method 600 to verify that an input spectral component includes a feedback artifact after identifying an indication of feedback in the input spectral component.

At block 602, the method 600 includes reducing a gain applied to an input spectral component by a reduction factor. The sound processor 218 applies (or causes another component to apply) the reduction factor to the gain for the input spectral component by performing the same or substantially similar functions as those described with respect to the feedback detection module 312 and FIG. 4C.

As an alternative implementation of the block 602, the sound processor 218 causes a feedback filter to filter a feedback artifact from the input spectral signal. In this example, filtering the feedback artifact may have the same or a substantially similar effect on the signal level of the input spectral component as described with respect to applying the reduction factor to the gain.

At block 604, the method 600 includes determining a change in signal level of the input spectral component. The sound processor 218 performs the same or substantially similar steps as those described with respect to block 502 of the method 500 when performing the steps of block 604.

At block 606, the method 600 includes comparing the change to a predicted change in order to verify that feedback is building in the input spectral component. As previously described, the predicted change for the Cth frequency channel corresponds to a change in the signal level of the input spectral component that that is indicative of the input spectral component including a feedback artifact. The sound processor 218 compares the change to the predicted change by performing functions that are the same as or are substantially similar to those described with respect to the feedback detection module 312 and FIG. 4D. If the change is about equal to the predicted change, the sound processor 218 verifies that feedback is building in the input spectral component.

At block 608, the method 600 includes a decision point. If feedback is not verified to be building in the input spectral component, the method 600 ends.

If feedback is verified to be building in the input spectral component, the method 600 includes applying a modification to one or more parameters used to process the input spectral component, at block 610. The sound processor 218 employs any suitable modification(s) suitable for minimizing the feedback artifact included in the input spectral component. In one example, the sound processor 218 reduces the gain applied to the input spectral component until the indication of feedback is no longer detected in the input spectral component.

In another example, the sound processor 218 applies a phase shift to the input spectral component. In yet another example, the sound processor 218 applies a frequency shift to the input spectral component. In still another example, the sound processor 218 implements, or causes another component of the hearing prosthesis to implement, a feedback filter configured to filter the feedback artifact from the input spectral component.

After completing the steps of block 610, the method 600 ends.

Figure 7:
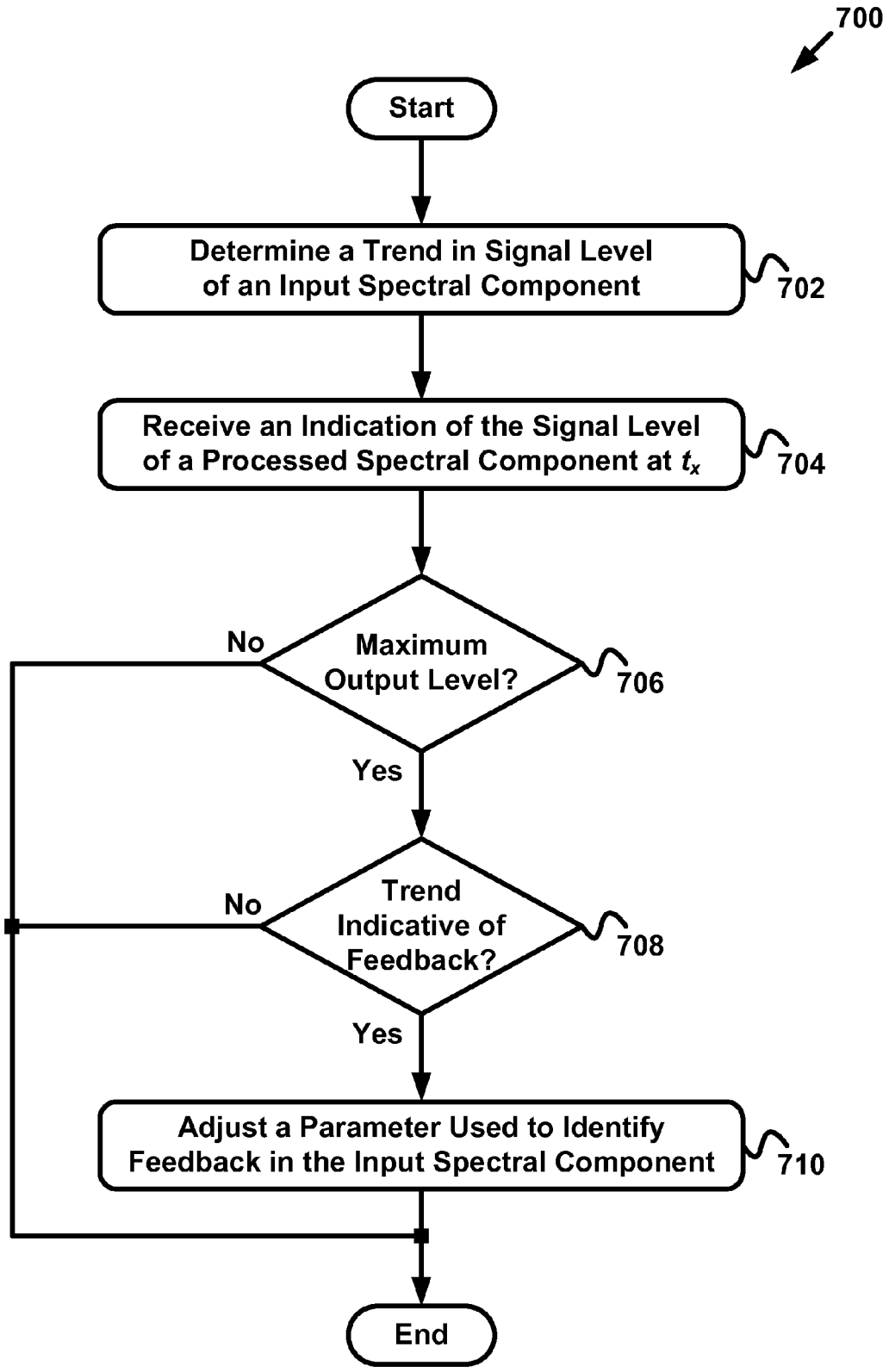
FIG. 7 is a flow diagram of a method for training a system configured to identify an indication of feedback in an input spectral component, according to an example.

FIG. 7 is a flow diagram of a method 700. A sound processor performs the steps of the method 700 to determine whether an input spectral component included in a processed signal includes audible feedback and, if the input spectral component includes audible feedback, to train a feedback detection system to adapt to a change in an external feedback loop.

The sound processor 218 performs the method 700 once every update interval $t_u$. In one example, the update level $t_u$ is frequency dependent. In this example, the update interval $t_u$ is approximately equal the external time delay $td_2$ for the Cth frequency channel. In another example, the update interval $t_u$ is standardized for one or more frequency channels. In this example, the update interval $t_u$ is a lowest external time delay $td_2$ corresponding to the one or more frequency channels.

At block 702, the method 700 includes determining a trend in a signal level of an input spectral component. The sound processor 218 performs the same or substantially similar steps as those described with respect to block 522 of the method 520 when determining the trend in the signal level of the input spectral component.

At block 704, the method 700 includes receiving an indication of a signal level of a processed spectral component. The sound processor 218 receives the indication of the signal level of the processed spectral component from a component configured to perform the functions of the amplification module 308. Alternatively, the sound processor 218 receives the indication of the processed signal level upon generating the processed spectral signal 309.

At block 706, the method 700 includes determining whether the signal level of the processed spectral component is at a maximum output level. The sound processor 218 compares the processed signal level to a maximum output level for the Cth frequency channel. In one example, the sound processor 218 accesses the data storage 216 to identify the maximum output level.

If the sound processor 218 determines that the signal level of the processed spectral component is less than the maximum output level, the method 700 ends. If the sound processor 218 determines that the signal level of the processed spectral component is equal to the maximum output level, the method 700 includes determining if the trend is indicative of feedback, at block 708. The sound processor 218 performs the same or substantially similar steps as those described with block 524 of the method 520 when performing the steps of block 708.

In one example, the SPL of the sound at the Cth frequency channel is sufficiently high enough to cause the processed signal level to correspond to the maximum output level. For instance, if the recipient is in a noise environment, the source of the sound 301 may be sufficiently loud to result in the processed signal level being the maximum output level. In this example, the trend does not indicate feedback. That is, the trend does not indicate a logarithmic increase in the input signal level.

In another example, feedback causes the processed signal level to reach the maximum output level, thereby causing an audible feedback artifact to be included in the processed spectral signal 309. In this example, the sound processor 218 did not detect feedback, perhaps due to a change in the propagation path (i.e., recipient touches a surface, thereby changing the propagation path of one or more mechanical waves) or a change in the acoustic environment that changes the external time delay $td_2$ and/or the attenuation factor H corresponding to the Cth frequency channel. Consequently, the threshold change was not sufficient to allow the sound processor 218 to identify the indication of feedback in the input spectral component.

If the trend is not indicative of feedback, the method 700 ends. If the trend is indicative of feedback, the method 700 includes adjusting a parameter used to identify feedback in the input spectral component, at block 710. In one example, the sound processor 218 increases the threshold change corresponding to the Cth frequency. The sound processor 218 determines the increase in the threshold change such that the system 300 slowly adapts to the changes in the external feedback loop 110. Slowly adjusting the threshold change may improve the performance of the system 300 and the hearing prosthesis 100 if the change in the external environment is transient.

After performing the steps of block 710, the method 700 ends.

In the above description, the methods, systems, and devices are described with respect to a use that includes a hearing prosthesis and/or a hearing aid that is configured to deliver a stimulus to a recipient via a mechanical and/or an acoustical force. Alternatively, the methods, systems, and devices described herein may be used in other applications in which it is desirable to identify and suppress feedback artifacts prior the feedback artifacts being audible.

For instance, consider an example in which music is being performed by one or more acoustic instruments. In order to record or project the music, a sound system may receive, process, and output the music via one or more speakers. In these examples, one or more microphones, pickups, or similar device are used to receive sound from one or more acoustic instruments, such as an acoustic guitar, a violin, a cello, a bass, and/or the like. Depending on the external acoustics of the venue, the sound system may be susceptible to the same or similar feedback as described herein with respect to the hearing prosthesis 100. Applying the methods, systems, and devices described herein in this example application may reduce a likelihood of audible feedback being output by the one or more speakers. Other example applications are also possible.

With respect to any or all of the block diagrams, examples, and flow diagrams in the figures and as discussed herein, each step, block and/or communication may represent a processing of information and/or a transmission of information in accordance with example embodiments. Alternative embodiments are included within the scope of these example embodiments. In these alternative embodiments, for example, functions described as steps, blocks, transmissions, communications, requests, responses, and/or messages may be executed out of order from that shown or discussed, including in substantially concurrent or in reverse order, depending on the functionality involved. Further, more or fewer steps, blocks and/or functions may be used with any of the message flow diagrams, scenarios, and flow charts discussed herein, and these message flow diagrams, scenarios, and flow charts may be combined with one another, in part or in whole.

A step or block that represents a processing of information may correspond to circuitry that can be configured to perform the specific logical functions of a herein-described method or technique. Alternatively or additionally, a step or block that represents a processing of information may correspond to a module, a segment, or a portion of program code (including related data). The program code may include one or more instructions executable by a processor for implementing specific logical functions or actions in the method or technique. The program code and/or related data may be stored on any type of computer-readable medium, such as a storage device, including a disk drive, a hard drive, or other storage media.

The computer-readable medium may also include non-transitory computer-readable media such as computer-readable media that stores data for short periods of time like register memory, processor cache, and/or random access memory (RAM). The computer-readable media may also include non-transitory computer-readable media that stores program code and/or data for longer periods of time, such as secondary or persistent long term storage, like read only memory (ROM), optical or magnetic disks, and/or compact-disc read only memory (CD-ROM), for example. The computer-readable media may also be any other volatile or non-volatile storage systems. A computer-readable medium may be considered a computer-readable storage medium, for example, or a tangible storage device.

Moreover, a step or block that represents one or more information transmissions may correspond to information transmissions between software and/or hardware modules in the same physical device. However, other information transmissions may be between software modules and/or hardware modules in different physical devices.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A sound processor configured to:

identify a feedback artifact in a current sample of an input spectral component by determining that a change in a signal level of the input spectral component is approximately equal to a predicted change; and responsive to identifying the feedback artifact, apply a modification to a parameter used to process the current sample of the input spectral component, wherein the modification reduces a likelihood of including audible feedback in a processed input spectral component.

2. The sound processor of claim 1, wherein the sound processor is further configured to determine a previous change in the signal level of the input spectral component between a first previous sample of the input spectral component and a second previous sample of the input spectral component, wherein the first previous sample precedes the second previous sample.

3. The sound processor of claim 2, wherein, to identify the feedback artifact, the sound processor is further configured to:

determine that the previous change is greater than or equal to a threshold change; and in response to determining that the previous change is greater than or equal to the threshold change, identify the previous change as an indication of feedback in the second previous sample.

4. The sound processor of claim 3, wherein the threshold change represents a difference between two samples of the input spectral component that is indicative of the input spectral component including the feedback artifact.

5. The sound processor of claim 1, wherein the sound processor is further configured to determine a trend in the signal level of the input spectral component over a period of time.

6. The sound processor of claim 5, wherein, to identify the feedback artifact, the sound processor is further configured to:

determine that the trend increases at an approximately exponential rate; and in response to determining that the trend increases at the approximately exponential rate, determine that the input spectral component includes the feedback artifact.

7. The sound processor of claim 1, wherein, to apply the modification to the parameter, the sound processor is further configured to apply a feedback filter to subsequent samples of the input spectral component.

8. The sound processor of claim 1, wherein the parameter is one of a gain, a phase shift, or a frequency shift.

9. The sound processor of claim 1, wherein the modification is based on at least one characteristic of an external feedback loop.

10. The sound processor of claim 1, wherein the sound processor is configurable for use in a hearing prosthesis.

11. The sound processor of claim 1, wherein the predicted change is based on one or more characteristics of an external feedback loop.

12. A method comprising:

determining a first change in an input spectral component of an input spectral signal over a first period of time;

determining that the first change is indicative of the input spectral component including a feedback artifact; and in response to determining that the first change is indicative of the input spectral component including the feedback artifact, reducing an amount of spectral information of the input spectral component included in a processed spectral signal by a reduction factor, and determining that a second change in the input spectral component over a second period of time is about equal to the reduction factor, wherein the second period of time is subsequent to the first period of time.

13. The method of claim 12, wherein reducing an amount of spectral information of the input spectral component included in the processed spectral signal comprises filtering the feedback artifact from the processed spectral signal.

14. The method of claim 12, wherein reducing an amount of spectral information of the input spectral component included in the processed spectral signal comprises reducing a gain applied to the input spectral component when generating the processed spectral signal.

15. The method of claim 12, further comprising, in response to determining that the second change in the input spectral component is about equal to the reduction factor:

determining that the second change in the input spectral component is indicative of the feedback artifact; and applying a modification to at least one parameter used to generate an output spectral signal based on the input spectral signal, wherein applying the modification reduces an energy level of the feedback artifact.

16. The method of claim 15, wherein determining that the second change in the input spectral component over a period of time is about equal to the reduction factor comprises determining that the second change is within a tolerance of the reduction factor, wherein the tolerance is based on one or more characteristics of an external feedback loop.

17. The method of claim 12, wherein the first period of time and the second period of time are less than or equal to an external time delay in an external feedback loop at a frequency corresponding to the input spectral component.

18. A method comprising:

generating an output signal that includes one or more output spectral components;

determining that an output spectral component included in the one or more output spectral components includes audible feedback;

in response to determining that the output spectral component includes audible feedback, adjusting a setting of a variable used to detect a feedback artifact in an input spectral component of an input signal, wherein a frequency of the input spectral component corresponds to a frequency of the output spectral component, and wherein the adjusted setting minimizes a likelihood of audible feedback being included in a subsequent output signal; and using the adjusted setting to detect feedback artifacts in one or more subsequent inputs signals.

19. The method of claim 18, wherein determining that the output spectral component audible feedback comprises:

determining a trend of a signal level of the input spectral component over a period of time; and determining that the trend is indicative of the input spectral component including a feedback artifact.

20. The method of claim 19, wherein determining that the trend is indicative of the input spectral component including the feedback artifact comprises determining that the trend corresponds to an exponential increase in the signal level of the input spectral component.

* * * * *